United States Patent [19]

Wiskur

[11] Patent Number: 4,733,799

[45] Date of Patent: Mar. 29, 1988

[54] WATER CANNON TOY OR LIKE DEVICE

[76] Inventor: Darrell D. Wiskur, Rte. 7, Harrison, Ark. 72601

[21] Appl. No.: 832,352

[22] Filed: Feb. 24, 1986

[51] Int. Cl.[4] ..... A63H 3/18

[52] U.S. Cl. ..... 222/79; 222/320; 222/386; 124/65; 446/473

[58] Field of Search ..... 222/79, 495, 386, 333, 222/319, 320, 42, 597, 189; 239/587; 124/56, 65, 64, 63; 446/176, 180, 181, 191, 473

[56] References Cited

U.S. PATENT DOCUMENTS

| | | | |
|---|---|---|---|
| 1,394,456 | 10/1921 | Wanat | 222/79 |
| 1,670,210 | 5/1928 | Parker | 222/386 |
| 1,817,769 | 8/1931 | Schmidt | 222/79 |
| 1,979,014 | 10/1934 | Schleit | 222/79 |
| 2,175,601 | 10/1939 | Grund | 222/386 |
| 2,376,231 | 5/1945 | Cohn | 222/189 |
| 2,435,527 | 2/1948 | Arpin | 222/79 |
| 2,828,579 | 4/1958 | Schwerbel et al. | 222/79 |
| 3,251,353 | 5/1966 | Battaglia | 124/65 |
| 3,316,908 | 5/1967 | Burke | 222/189 |

*Primary Examiner*—Joseph J. Rolla
*Assistant Examiner*—Kenneth Noland
*Attorney, Agent, or Firm*—Haverstock, Garrett & Roberts

[57] ABSTRACT

An improved water gun toy or like device having a cylindrical body substantially closed at one end thereof to form a body chamber, a piston of cylindrical shape slidably and sealably positioned within said body chamber for axial movement therein, the piston and the body including the closed end thereof defining a liquid receiving reservoir of substantial capacity. The piston is slidable from one axial end of the body chamber to the other axial end thereof. A conduit in fluid communication at one end with the reservoir and having an outlet orifice on the opposite downstream end thereof from which liquid can be ejected and manual actuating device operatively connected to the piston and operable to cause axial movement of the piston from one axial end of the chamber to the other axial end thereof is provided whereby substantially all of the liquid in said reservoir may be ejected through the orifice in a continuous stream. In the preferred embodiment of the present invention, the actuating device comprises a hand crank which is adapted to be rotated by the user to cause axial movement of the piston and in an alternate embodiment the piston is connected to a gun stock portion, adapted to be supported against the user's body whereby the piston may be immobilized and the body moved axially rearwardly by the user to cause a reduction in the volume of the reservoir and ejection of a continuous stream of reservoir liquid.

7 Claims, 4 Drawing Figures

10
12
14
16
18
20
22
24
26
28
30
32
34
36
37
38
40
42
44
46
48
50
52
53
54
55
56
58
60
62
64
66
68
70
72
74
76
78
80
82
84
86
88
90
92
94
96
98

WATER CANNON TOY OR LIKE DEVICE

BACKGROUND OF THE INVENTION

1. Field of the Invention

The present invention relates generally to a water gun toy or like device for ejecting a continuous and substantial stream of liquid over a considerable distance and, more particularly, to a toy or like device having a piston mounted for axial movement within a cylindrical chamber forming with the piston a liquid reservoir and an actuating means operable to move the piston to reduce the volume of the liquid reservoir to forceably eject water therefrom.

2. Description of the Related Art

Many different types of toy water guns are known. One common type of water gun, such as disclosed in U.S. Pat. Nos. 4,214,674 to Jones et al, 4,406,383 to Duncan and 4,492,318 to Luk et al, utilizes a trigger-operated pump which may be repeatedly actuated to sequentially eject a series of discreet, small quantities of water from a separate, relatively larger capacity water reservoir. Such water gun toys suffer from the disadvantage of being relatively complicated and expensive to manufacture. Another type of water gun has a flexible deformable body forming a liquid reservoir which when squeezed to reduce the volume thereof acts to eject a portion of the liquid contained therein as stream, but a number of separate squeezing operations are necessary to exhaust the reservoir and the flow therefrom is not a continuous stream. None of these prior art devices is capable of delivering a continuous, substantial and forceful stream of water by utilization of a simple, inexpensive water gun apparatus.

SUMMARY OF THE INVENTION

The present invention overcomes these and other disadvantages and shortcomings of the prior art and is embodied in a water cannon toy or like device that is capable of ejecting a continuous, substantial and forceful stream of water over a considerable distance. The present device includes a cylindrical body defining a body chamber in which is slidably positioned a cylindrically-shaped piston which is movable from one axial end of the body chamber to the other. The piston and body chamber define a liquid receiving reservoir. A single compressive stroke of the piston from one axial end of the body chamber to the other ejects substantially all the liquid in the reservoir.

An actuating means to axially move the piston relative to the body is operatively connected to the piston. Although the actuating means may be of several different constructions, it basically comprises an elongated piston rod, one end of which is fixed to the piston, and another portion of which is operatively connected to a means for applying an axial force to the piston rod to move the piston relative to the body to reduce the volume of the liquid reservoir and thereby eject liquid held therein.

In the preferred embodiment, the actuating means includes a rotatable crank extending externally from the device and attached to an internal toothed gear which cooperatively engages recesses spaced along one side of the piston rod. The crank may be manually rotated to move the piston in an axial direction to reduce the volume of the reservoir and pressurize the liquid within the reservoir for ejection through a nozzle orifice formed in the free end of the piston rod.

In another embodiment of the present invention, the actuating means includes a curved gun stock member attached to the free end of the piston rod which functions as a butt end of a gun stock. The stock member is placed against a user's body to immobilize the piston as the cylindrical body is moved relative thereto by pulling it rearwardly toward the user by utilization of handles projecting from the body.

In either embodiment of the present invention the user is able to generate a substantial pumping force in a continuous manner to eject a relatively large continuous stream of liquid over a considerable distance.

It is therefore a primary object of the present invention to provide an improved water gun toy or like device which may be used to eject substantially all the water contained therein in a continuous stream or used to eject one or a series of discrete fractional portions of such water.

Another object is to provide a relatively simple and inexpensive water gun capable of ejecting liquid over a considerable distance.

Another object is to provide a water gun of a construction to minimize leakage therefrom but is easy to fill.

Another object is to provide a water gun with an integral, relatively large capacity liquid reservoir of variable volume.

Another object is to provide a water gun from which a substantial stream of water may be continuously accurately directed at a target.

BRIEF DESCRIPTION OF THE DRAWINGS

These and other objects and advantages of the present invention will become apparent to those skilled in the art after considering the following detailed description in conjunction with the accompanying drawings, wherein.

DESCRIPTION OF THE PREFERRED EMBODIMENTS

Figures 1, 2:
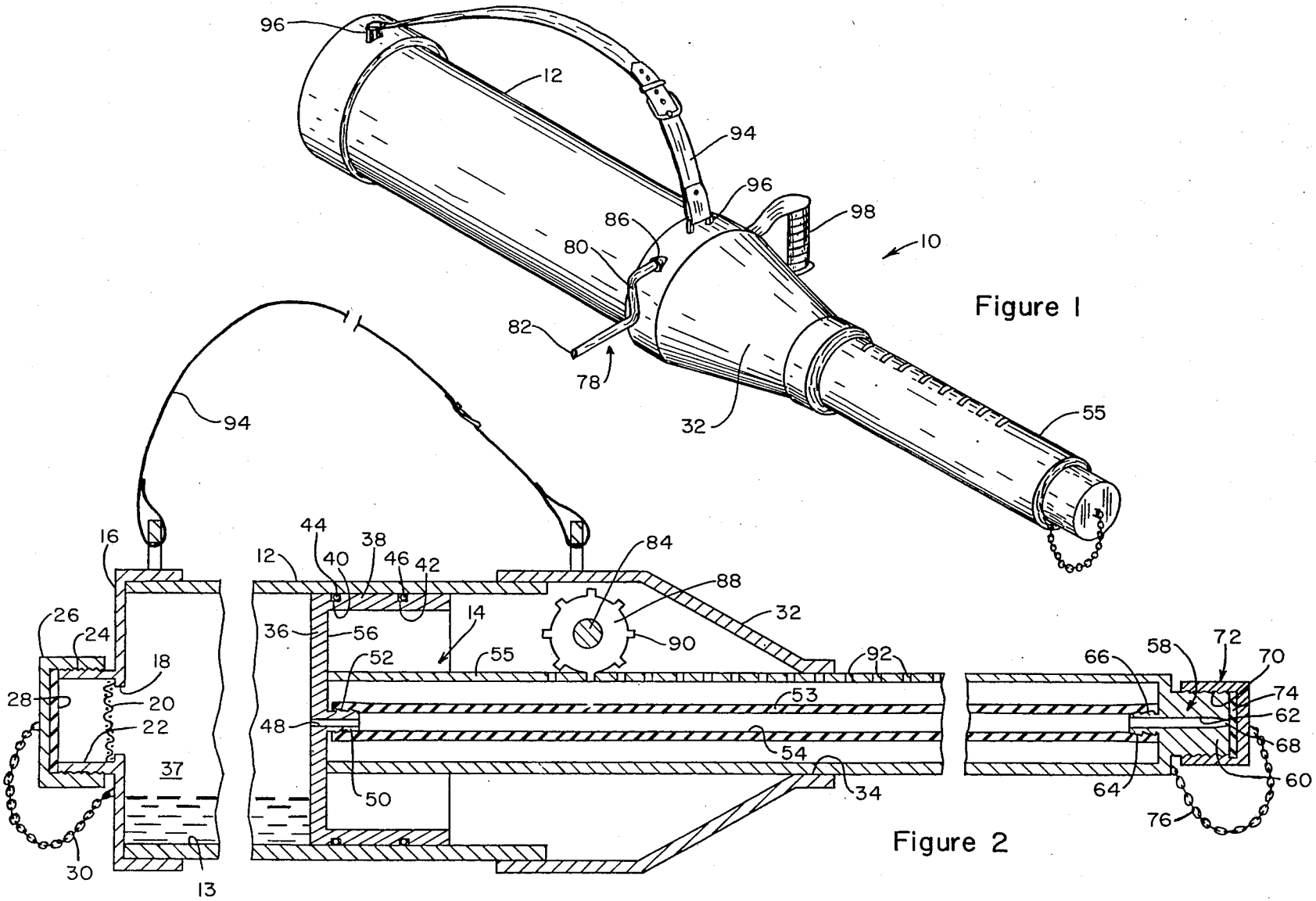
FIG. 1 is a perspective view of one embodiment of the device according to the present invention.
FIG. 2 is a cross sectional view taken along the longitudinal axis of the device shown in FIG. 1.

Referring to the drawings more particularly by reference numbers wherein like numerals refer to like parts, a device 10 constructed according to the teachings of the present invention is shown in FIGS. 1 and 2. The device 10 includes an elongated, cylindrical body assembly 12, preferably constructed of polyvinylchloride, or the like, having an internal cylindrical body chamber 13 slidably receiving a piston assembly 14. The body assembly 12 is closed at its rear end by a circular rear end wall 16 fixed to the body assembly 12. The end wall 16 includes a central opening 18 covered by a liquid straining screen 20 about which is fixed an annular filler flange 22. The outer periphery 24 of flange 22 is threaded to removably receive a threaded filler cap 26. The cap 26 is provided with a liquid sealing gasket 28 between the inner face of the cap 26 and the outer end of the filler flange 22 and a flexible connector 30 is provided to removably retain the cap 26 on the end wall 16. On the forward end of the body assembly 12 a funnel-shaped collar 32 is fixed, the forward end of which includes a cylindrical flanged opening 34.

The piston assembly 14 may also be constructed of PVC plastic, or the like, and comprises a cylindrical piston 36 defining with the cylindrical body 12 and the end wall 16 a cylindrical liquid receiving reservoir 37 of substantial and varying volume. The piston 36 includes an annular skirt 38 in the outer periphery of which are a pair of axially spaced, annular grooves 40, 42 for receiving a pair of liquid sealing rings 44, 46. It is important that these rings block and seal against any flow of liquid from the reservoir 37 side of the piston 36 to the other. At the axial center of the piston 36, an axial liquid passage 48 is provided on the forward end of which is fixed an annular nipple 50. The outer periphery of the nipple 50 is provided with annular thread-like projections 52 for sealably engaging one end of a flexible conduit 53 constructed of rubber or plastic tubing, or the like, the conduit 53 including an inner liquid passage 54 of a relatively small diameter to facilitate ejection of all the liquid therein.

An elongated tubular piston rod 55 is fixed to the forward face 56 of the piston 36 co-axially about the nipple 50 and the conduit 53. The forward end of the piston rod 55 extends through the body 12 and is slidably received within the cylindrical opening 34 of the collar 32. The forward or free end of the tubular piston rod 55 is closed by a nozzle block 58 which comprises an annular flange 60 having an axial bore therethrough defining a fluid conducting nozzle passage 62. Positioned about and extending rearwardly from the rear end of the nozzle passage 62 is an annular nipple 64, the outer periphery of which is provided with thread-like projections 66 for sealably receiving the forward end of the flexible conduit 53. The forward end of the nozzle passage 62 is of reduced diameter tapering inwardly toward the downstream end thereof to form a fluid outlet orifice 68. The outer periphery 70 of the nozzle block 58 is threaded to removably receive a threaded nozzle cap 72 having a gasket 74 to provide a liquid seal at the nozzle orifice 68. The nozzle cap 72 is provided with a flexible connector 76 removably retaining the cap 72 on the nozzle block 58. It is important that nozzle cap 72 and gasket 74, as well as the filler cap 26 and gasket 28 provide an adequate seal to guard against liquid leakage therefrom.

To actuate the water gun device 10 according to the present invention, a manually rotatable hand crank assembly 78 is provided. The hand crank assembly 78 comprises a crank shaft 80, the offset outer end 82 of which is adapted to be grasped in the hand of a user of the present device. An inner portion 84 of the crank shaft 80 is journaled in the collar 32 and is axially fixed but rotatably supported in two peripheral sides of the collar 32 by bearing surfaces 86, one of which is shown in FIG. 1. Mounted centrally within the collar 32 on the inner portion 84 of the crank shaft 80 is a drive gear 88 keyed or otherwise secured to the crank shaft 80. The drive gear 88 includes a plurality of teeth 90 drivingly received in cooperating slots 92 provided along the length of the upper periphery of the piston rod 55. These slots 92 also permit air passage to and from the body assembly 12 on the forward side of the piston assembly 14 during axial movement thereof.

To facilitate supporting and aiming the device 10 during use an adjustable strap 94 is connected to body assembly 12 at spaced locations by connectors 96. A handle 98, which is adapted to be grasped by the user, is fixed to the body assembly 12 on a side thereof opposite to the hand crank 78 and provides additional support for the device while it is being used.

Operation of the device 10 according to the present invention is as follows. The filler cap 26 is removed and the crank shaft 78 rotated in a counterclockwise direction to move the piston rod 55 and piston assembly 14 to its full forward position to maximize the volume of the reservoir 37. The device 10 is then held in a generally vertical position with the nozzle block 58 lowermost and the reservoir 37 filled with liquid by pouring the same through the annular filler flange 22 and screen 20. The filler cap 26 is then threadedly replaced on the flange 22, the device 10 supported on the user's shoulder by the strap 94, the nozzle cap 72 removed, and the handle 98 grasped to aim the nozzle of the device in the desired direction. The crank shaft 78 is then grasped and forcefully rotated in a clockwise direction for a compressive stroke to thereby cause the piston assembly to move rearwardly to reduce the volume of the reservoir 37. The increased pressure in the reservoir 37 forces the liquid therein to rise and causes the entrapped liquid to move through the piston axial passage 48, through the flexible conduit passage 54 and the nozzle passage 62 for forceful ejection of the liquid through and from the orifice 68. Continuous rotation of the crank shaft 78 results in continuous reduction of the volume of the reservoir 37 and continuous ejection of a substantial stream of liquid from the device 10 until the piston assembly is moved to its rearward limit by bottoming of the piston 26 against the rear end wall 16. The more forceful the rotation, the more forceful the fluid ejection. It is apparent however, that the operation of the device can be interrupted at any time to conserve liquid for later use and that the device may be operated intermittently.

Figure 3:
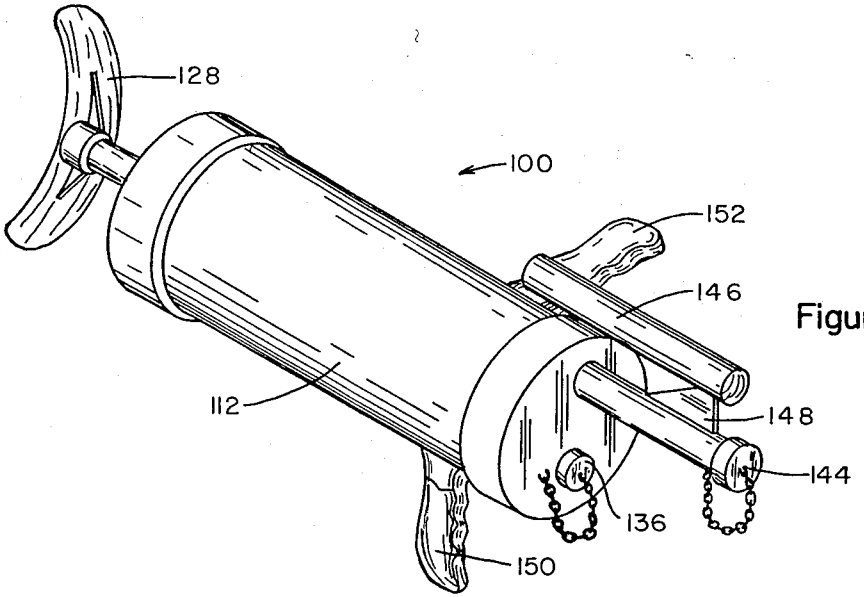
FIG. 3 is a perspective view showing another embodiment of the device according to the present invention.
Figure 4:
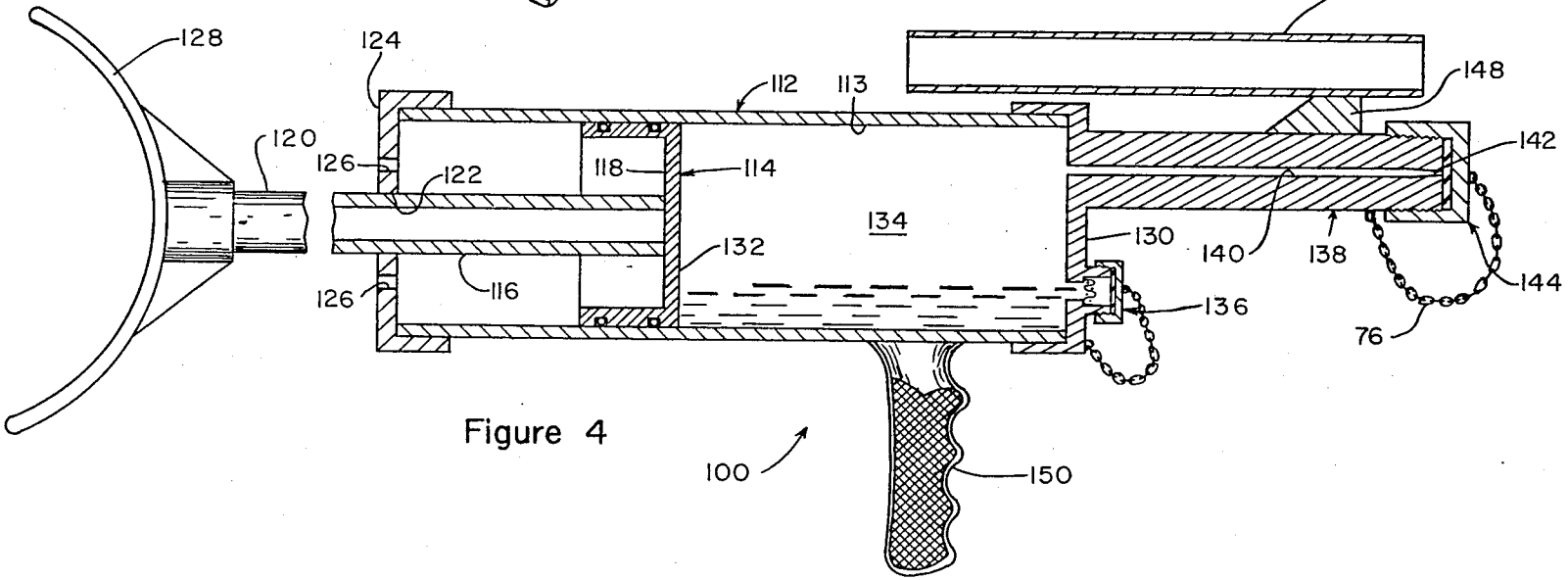
FIG. 4 is a cross sectional view taken along the longitudinal axis of the device shown in FIG. 3.

The embodiment 100 of the present invention shown in FIGS. 3 and 4 is in principal, construction and operation similar to the first discussed embodiment. Referring in more detail to FIGS. 3 and 4, the device 100 comprises an elongated cylindrical body assembly 112 including a cylindrical body chamber 113 slidably receiving a piston assembly 114. In this embodiment a piston rod 116 is fixed to the rear face 118 of the piston assembly 114. The opposite rear or free end 120 of the piston rod 116 projects through a cylindrical opening 122 in the rear end wall 124 of the body assembly 112. The end wall 124 has one or more vents 126 to permit passage of air to accommodate axial movement of the piston assembly 114. On the rear end 120 of the piston rod 116, a curved, laterally projecting gun stock 128 is fixed which is adapted to be positioned on or against the shoulder or chest of the user of the device 100.

The forward end of the body assembly 112 includes a forward end wall 130 defining with the cylindrical body assembly 112 and a forward face 132 of the piston assembly 118, a liquid reservoir 134. The forward end wall 130 further includes a threaded filler cap assembly 136 similar to that shown in FIG. 2 and a gun-barrel-like nozzle assembly 138 having an axially extending nozzle passage 140 therein, which passage, like the passage 54 of the embodiment of FIGS. 1 and 2, is of a relatively small diameter. The forward end of the nozzle passage 140 is tapered inwardly toward the downstream end thereof to form an outlet orifice 142 of reduced diameter relative to the passage 140 which may be closed and sealed by a nozzle cap assembly 144 threadedly mounted on the forward end of the nozzle assembly 138.

An optional tubular sight 146 is shown mounted on the top surface of nozzle assembly 138 by a sight mounting plate 148 so that the axes of the tubular sight, the nozzle passage 140 and the orifice 142 are generally parallel. A similar sight may be mounted on the embodiment of the present invention shown in FIGS. 1 and 2. A pair of hand grips 150, 152 are fixedly mounted on the bottom and side, respectively, of the body assembly 112 so that when the hand grips 150, 152 are grasped by the user and the gun stock supported against the user's shoulder or chest, the tubular sight may be utilized for aiming at a target.

Operation of the water cannon device 100 shown in FIGS. 3 and 4 is similar to the embodiment shown in FIGS. 1 and 2 except that after filling, the hand grips 150, 152 are pulled rearwardly for a compressive stroke to cause the cylindrical body assembly 112 to move rearwardly while the piston assembly 118 remains stationary by virtue of the gun stock 128 pressing against the body of the user. Continuous rearward movement of the body assembly results in continuous reduction of the volume of the reservoir 134 which, while the compression is maintained, causes a continuous stream of liquid to be ejected through the orifice 142 until the liquid is exhausted.

Thus there has been shown and described a novel water gun device for ejecting a stream of water, which device fulfills all of the objects and advantages sought therefor. Many changes, modifications, variations and other uses and applications of the present construction will, however, become apparent to those skilled in the art after considering this specification and the accompanying drawings. For example, a device constructed according to the principles of the present invention may be used to eject liquids and fluids other than water or may be used in other than a toy application, such as a fire extinguisher for extinguishing small fires, such as charcoal barbeque grill fires. Additionally, the present invention could be equipped with other types of nozzles for special applications, such as a spray or mist nozzle for an application in spraying or misting household plants or in other agricultural applications. All such changes, modifications, variations and other uses and applications which do not depart from the spirit and scope of the invention are deemed to be covered by the invention which is limited only by the claims which follow.

What is claimed is:

1. A water gun toy comprising a body having a handle member fixed thereto adapted to be grasped by a user and a body chamber internally of said body;

a piston positioned within said body chamber and slidable relative thereto, said piston and said body chamber defining a liquid receiving reservoir, a tubular piston rod having an inner end fixed to said piston and an outer end projecting from said body in the opposite direction from said user;

tubular conduit means positioned within said tubular piston rod, one end of said conduit means in fluid communication with said reservoir and the other end extending through said tubular piston rod to an orifice at said outer end thereof for ejecting liquid from said reservoir; and actuating means operatively connected to the piston rod operable for causing relative sliding movement of said piston within said body chamber to cause liquid in said reservoir to be ejected through said conduit means and orifice;

said actuating means including a hand crank rotatably mounted on said body, said crank including a crank shaft projecting within said body adjacent to said piston rod, a toothed gear fixedly mounted on said crank shaft, and means including tooth contacting surfaces formed along a length of said piston rod engageable with said toothed gear whereby rotation of said hand crank causes axial movement of said piston rod and said piston in said body chamber to change the volume of said reservoir.

2. The water gun of claim 1 further including filler means independent of said conduit means for filling said reservoir with liquid.

3. The water gun of claim 2 wherein said filler means includes a filler opening in said body communicating with said reservoir and a filler cap removably sealing said opening against escape of liquid therefrom.

4. The water gun of claim 1 further including liquid sealing means removably positioned on the outer end of said conduit means to seal said orifice against escape of liquid therefrom.

5. A water gun comprising an elongated hollow body substantially closed at one axial end thereof to define a body chamber;

a piston slidably positioned within said body chamber and conforming to the shape thereof for axial movement therein, said piston and said body defining a liquid receiving reservoir, said piston being slidable relative to said body from one axial end of said body chamber to the other axial end thereof;

a piston rod having an inner end connected to said piston, and an outer end projecting from said body;

a flexible tube positioned internally of said piston rod, said piston having a liquid passage therein in fluid communication with said reservoir and with one end of said flexible tube, and an orifice in fluid communication with the other end of said flexible tube;

manual actuating means operatively connected to said piston and operable to cause relative axial movement between said piston and said body from said one axial end of said body chamber to said other axial end thereof whereby liquid in said reservoir will be ejected through said orifice in a continuous stream;

said manual actuating means including means operatively connected to said piston rod, said manual actuating means including a manually operable hand crank rotatably mounted on said body, said crank including a crank shaft projecting within said body adjacent said piston rod, a toothed gear fixedly mounted on said crank shaft, and means including tooth contacting surfaces formed along a length of said piston rod engageable with said toothed gear whereby rotation of said hand crank causes axial movement of said piston rod and said piston in said body chamber to change the volume of the reservoir.

6. A water gun comprising an elongated hollow body substantially closed at one axial end thereof to define a body chamber;

a piston slidably positioned within said body chamber and conforming to the shape thereof for axial movement therein, said piston and said body defining a liquid receiving reservoir, said piston being slidable relative to said body from one axial end of said body chamber to the other axial end thereof;

a piston rod having an inner end connected to said piston and an outer end projecting from said body, said piston rod including an elongated tubular member having a tubular liquid passage therethrough of reduced size at the outer end thereof providing an orifice, said piston having a liquid passage therethrough in fluid communication with said reservoir and with the liquid passage through the piston rod and said orifice; and manual actuating means operatively connected to said piston rod and operable to enable relative axial movement between said piston and said body from said one axial end of said body chamber to said other axial end thereof whereby substantially all of the liquid in said reservoir may be ejected through the passage in the piston rod, said manual actuating means including a manually operable hand crank rotatably mounted on said body, said crank including a crank shaft projecting within said body adjacent to said piston rod, a toothed gear fixedly mounted on said crank shaft, tooth contacting surfaces including a plurality of spaced tooth receiving slots formed along a length of said piston rod for cooperating with said toothed gear whereby rotation of said hand crank causes axial movement of said piston rod and said piston through said body chamber to change the volume of the reservoir.

7. The water gun of claim 6 wherein said liquid passage through said piston rod includes a flexible tube positioned internally of said tubular member.

* * * * *